US011160331B2

(12) United States Patent
Chan

(10) Patent No.: US 11,160,331 B2
(45) Date of Patent: Nov. 2, 2021

(54) BUCKLE

(71) Applicant: Duraflex Hong Kong Limited, Hong Kong (CN)

(72) Inventor: Yick Fai Chan, Hong Kong (CN)

(73) Assignee: Duraflex Hong Kong Limited, Hong Kong (CN)

( * ) Notice: Subject to any disclaimer, the term of this patent is extended or adjusted under 35 U.S.C. 154(b) by 70 days.

(21) Appl. No.: 15/931,841

(22) Filed: May 14, 2020

(65) Prior Publication Data

US 2021/0219668 A1 Jul. 22, 2021

Related U.S. Application Data

(63) Continuation-in-part of application No. 16/745,485, filed on Jan. 17, 2020, now Pat. No. 11,089,843.

(51) Int. Cl.
*A44B 11/26* (2006.01)
*A44B 11/04* (2006.01)

(52) U.S. Cl.
CPC ..... *A44B 11/266* (2013.01); *A44B 11/04* (2013.01)

(58) Field of Classification Search
CPC ... A44B 11/16; A44B 11/266; A44B 11/2519; A44B 11/2592; Y10T 24/4552; Y10T 24/45581; Y10T 24/45628; Y10T 24/45524
See application file for complete search history.

(56) References Cited

U.S. PATENT DOCUMENTS 6,553,637 B1 4/2003 Chen
7,020,939 B2 4/2006 Anscher
7,979,966 B2 7/2011 Yoshie
8,112,850 B2 2/2012 Uehara
8,601,652 B2 12/2013 Uehara et al.
8,720,018 B2 5/2014 Yoshie et al.
(Continued)

FOREIGN PATENT DOCUMENTS

CN 101336763 A 1/2009
CN 101357013 B 10/2010
(Continued)

OTHER PUBLICATIONS

English Translation of The Notification of Transmittal of the International Search Report and the Written Opinion of the International Searching Authority, or the Declaration, dated Apr. 12, 2021 in Chinese Application No. PCT/CN2021/071379.

*Primary Examiner* — Robert Sandy
*Assistant Examiner* — Rowland Do
(74) *Attorney, Agent, or Firm* — Collard & Roe, P.C.

(57) ABSTRACT

A buckle has a main body, a strap retaining bar connected to the main body, two locking legs formed as separate pieces from the main body and pivotably connected to the main body; and a spring formed of two L-shaped sections disposed between the two locking legs. The spring is attached to both of the locking legs, and exerts a force against the locking legs when they are pressed inward toward each other. The spring keeps the locking legs in an outwardly tensioned position, but does not let the legs flex outwardly in an unlimited manner, since the spring is directly connected to the legs. The spring allows the main body and locking legs to be formed of an inflexible material, such as metal. The locking legs are separate pieces from the main body and are connected to the main body via a pivot pin or other hinged mechanism.

10 Claims, 5 Drawing Sheets

(56) References Cited

U.S. PATENT DOCUMENTS

| | | | |
|---|---|---|---|
| 8,769,783 | B2 | 7/2014 | Kawaguchi |
| 9,521,882 | B2 | 12/2016 | Hung |
| 9,655,412 | B2 | 5/2017 | Nanbu et al. |
| 10,617,180 | B1 | 4/2020 | Yen |
| 2003/0014851 | A1 | 1/2003 | Murai et al. |
| 2005/0207837 | A1 | 9/2005 | Kosh et al. |
| 2007/0186394 | A1 | 8/2007 | Hsiao |
| 2007/0204441 | A1 | 9/2007 | Saitsu |
| 2009/0007391 | A1 | 1/2009 | Uehara |
| 2010/0005632 | A1 | 1/2010 | Pigozzi |
| 2010/0306976 | A1 | 12/2010 | Kaneko et al. |
| 2018/0289113 | A1 | 10/2018 | Chu |

FOREIGN PATENT DOCUMENTS

| | | | |
|---|---|---|---|
| CN | 109222342 | A | 1/2019 |
| CN | 209677537 | U | 11/2019 |
| CN | 209898439 | U | 1/2020 |
| JP | 2008-148822 | A | 7/2008 |

BUCKLE

CROSS REFERENCE TO RELATED APPLICATIONS

This application is continuation-in-part of U.S. patent application Ser. No. 16/745,485 filed on Jan. 17, 2020, the disclosure of which is incorporated herein by reference.

BACKGROUND OF THE INVENTION

1. Field of the Invention

The present invention relates to a two-piece side-release buckle. In particular, the invention relates to a side release buckle in which the locking legs are tensioned in place by a separate spring.

2. The Prior Art

Conventional side release buckles are formed by a male part having two locking legs that engage a female part through slots in the side walls of the female part. The locking legs extend through the slots and are locked in place by locking flanges that abut the sides of the slots. The male part is released from the female part by the user squeezing the locking legs together until the locking flanges clear the slots and the male part can exit from the female part. In this type of structure, which is shown for example in U.S. Pat. No. 7,020,939B2, the locking legs are formed as one piece with the rest of the male part, and the spring force of the plastic keeps the legs in the locked position until the user releases them.

A two-piece side release buckle in which the locking legs are formed separately from the rest of the male part is shown in U.S. Pat. No. 10,617,180. Here, the locking legs are hinged to the male buckle body, and a plastic spring keeps them in place. This is beneficial when the buckle is to be made of metal, as the locking legs of the male portion do not have sufficient spring elasticity to function properly in the conventional structure described above. This way, the plastic spring provides sufficient elasticity to keep the locking legs in the locked position and allow for their release when pressed together. Here, the spring element is formed on a central leg of the male part and comprises flexible arms that extend outward and press against the metal locking legs to force them into an outward arrangement. The drawback of this structure is that it does not prevent the locking legs from moving outward along the full extent of the hinge point. This can make the male part difficult to insert into the female part, as well as increase the risk of damage to both parts.

SUMMARY OF THE INVENTION

It is therefore an object of the invention to provide a functional two-piece side release buckle that can be made of a variety of materials, including metal, yet retain the elasticity and shape necessary for efficient operation of the buckle.

This and other objects are achieved by a buckle comprising a main body, a strap retaining bar connected to the main body, two locking legs formed as separate pieces from the main body and pivotably connected to the main body; and a spring disposed between the two locking legs, the spring being attached to both of the locking legs. The spring exerts a force on the locking legs when they are pressed together by a user. The spring keeps the locking legs in an outwardly tensioned position, but does not let the legs flex outwardly in an unlimited manner, since the spring is directly connected to the legs. The spring allows the main body and locking legs to be formed of an inflexible material, such as metal. The locking legs are separate pieces from the main body and are connected to the main body via a pivot pin or other hinged mechanism.

In one embodiment, the spring is formed from two L-shaped sections, each formed by a vertical leg and a horizontal leg, that are connected together to form a U-shaped structure. This specific structure allows the spring to have sufficient flexibility in the direction where force is applied, yet have enough structural stability to avoid damage from forces in other directions. The horizontal leg of one section overlaps the horizontal leg of the other section to form the central part of the U-shape with the vertical legs forming the outer legs of the U-shape. These outer legs are connected to the locking legs of the buckle.

To connect the locking legs of the buckle to the spring, each of the locking legs has an engagement protrusion formed on an inner surface thereof, and the spring has engagement slots formed in the outer legs of the U-shape which are formed by the vertical legs of each of the two spring sections. The engagement protrusions extend into the engagement slots to connect the locking legs to the spring. Alternatively, the engagement protrusions can be located on the spring, and the engagement slots can be located on the locking legs. Other means of attachment could also be used.

In one embodiment, there is a central leg extending between the locking legs. This central leg extends through slots in the horizontal legs of each of the spring sections that form the central part of the U-shaped spring. Preferably, the central leg is longer than the locking legs.

The buckle according to the invention forms a male buckle portion of a two-piece buckle assembly in conjunction with a female buckle portion. The female buckle portion has a top face, a bottom face, and an interior cavity for receiving the male buckle portion. The bottom face of the female buckle portion has a cutout forming locking edges along sides of the bottom face. Each of the locking legs of the male buckle portion has a locking protrusion located on at least a bottom face of the locking legs, and preferably on both faces of the locking legs. The male buckle portion is locked to the female buckle portion by inserting the male buckle portion into the cavity until the locking protrusions engage the locking edges of the female buckle portion. The female buckle portion has a plurality of guide elements, so that during insertion of the male portion into the female portion, the central leg is guided between the guide elements to keep the male portion in alignment with the female portion. The guide elements separate the interior of the female portion into three channels. The central channel accommodates the central leg, and the outer channels accommodate the two locking legs. The longer central leg helps position the male portion in proper alignment with the female portion prior to the locking legs entering the female portion.

The female portion is constructed to have open sides, so that when the male portion is connected to the female portion, an entire length of each locking leg is exposed outside the female portion. This makes it easier for the user to press the locking legs together to release the locking legs, as a larger portion of each locking leg is available for contact with the user's fingers, and there is no risk of interference by the structure of the female portion during release.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
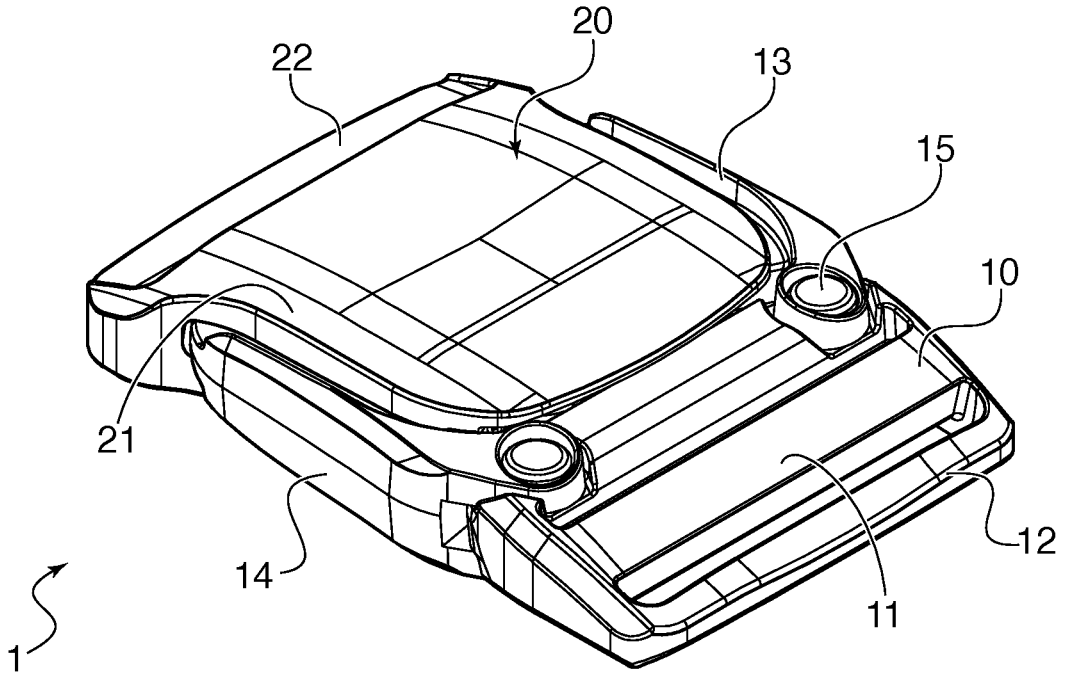
FIG. 1 shows a perspective view of the assembled buckle assembly according to the invention.
Figure 2:
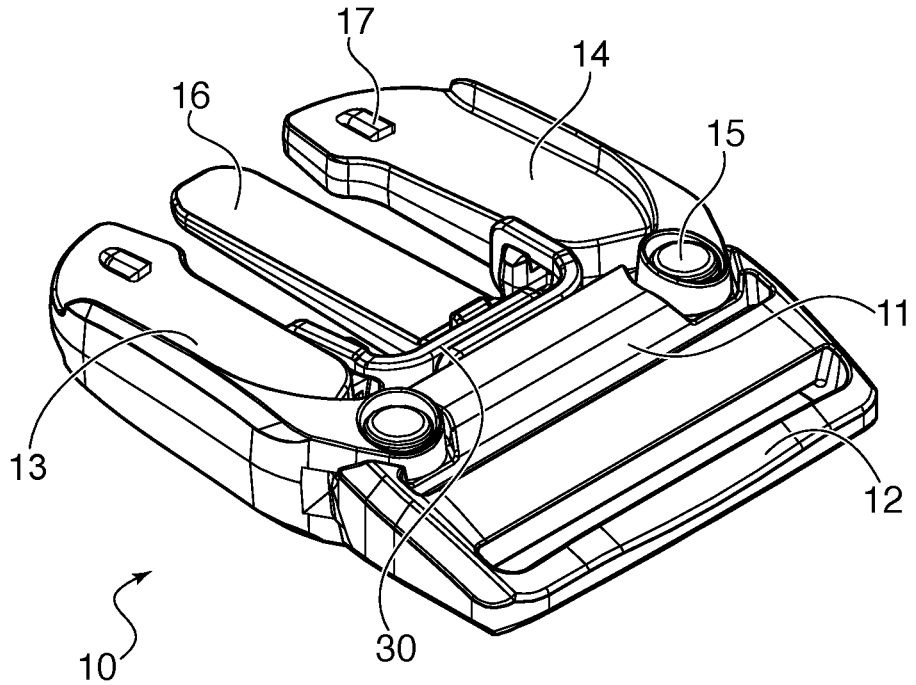
FIG. 2 shows a perspective view of the male buckle portion.
Figure 3:
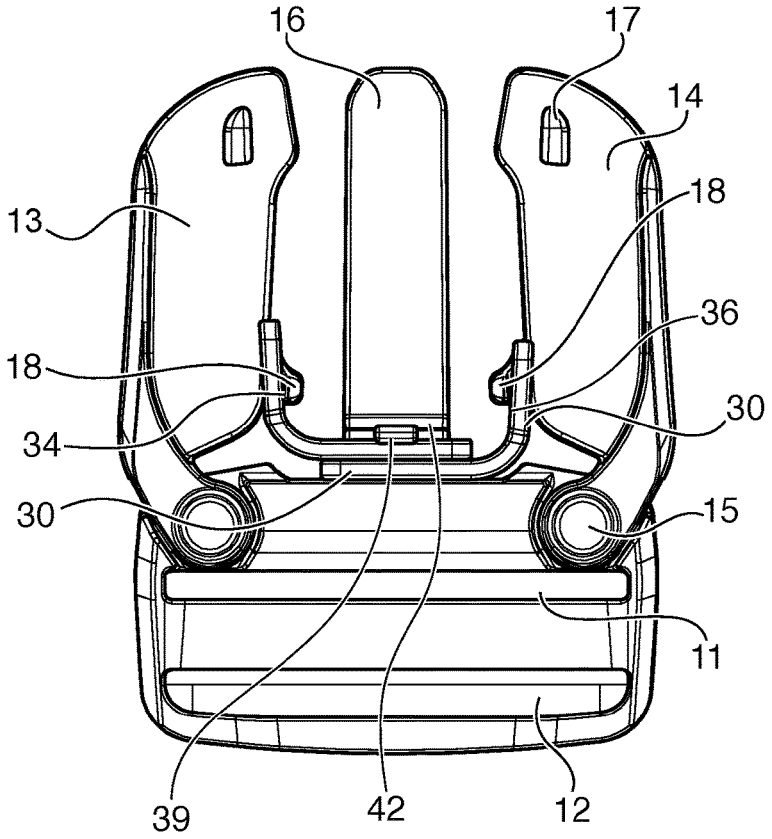
FIG. 3 shows a top view of the male buckle portion.
Figure 4:
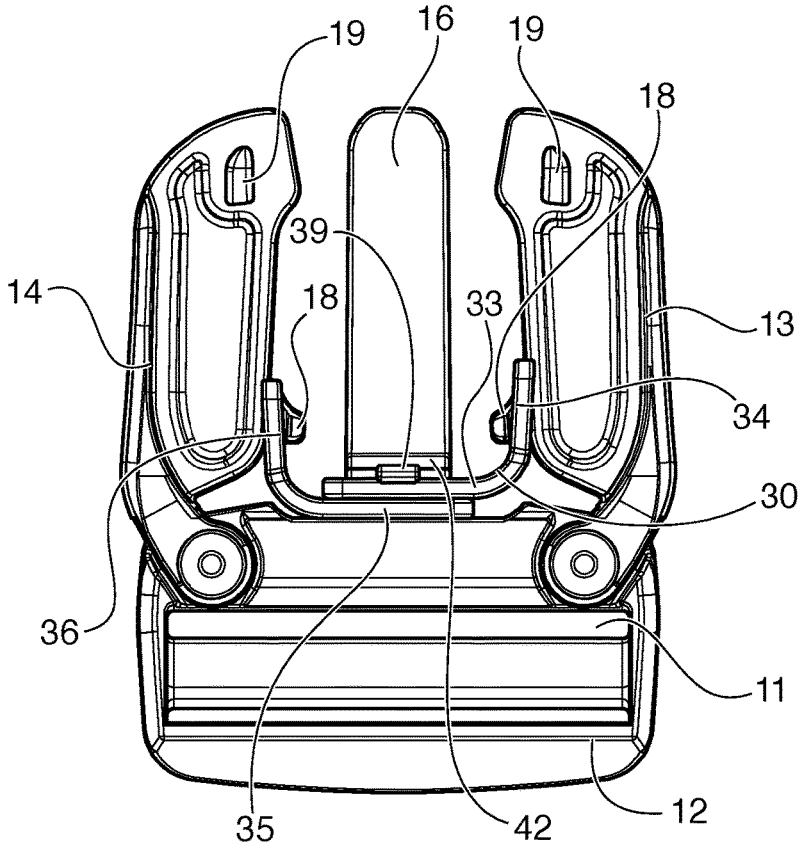
FIG. 4 shows a bottom view of the male buckle portion.

Referring now in detail to the drawings FIG. 1 shows a perspective view of the buckle assembly 1 according to the invention. Buckle assembly 1 is formed of a male buckle portion 10 and a female buckle portion 20. As also shown in FIGS. 2-4, male buckle portion 10 has a main body 11, a strap connecting bar 12 connected to main body 11, and two locking legs 13, 14. Locking legs 13, 14 are formed separately from main body 11 and are pivotably connected to main body 11 via hinge pins 15. A central leg 16 is fixedly connected to main body 11 and extends between locking legs 13, 14. Central leg 16 is longer than locking legs 13, 14. Locking legs 13, 14, have locking protrusions 17 located on the front face, and locking protrusions 19 located on the rear face, for locking engagement with female buckle portion 20, as explained below.

Figure 5:
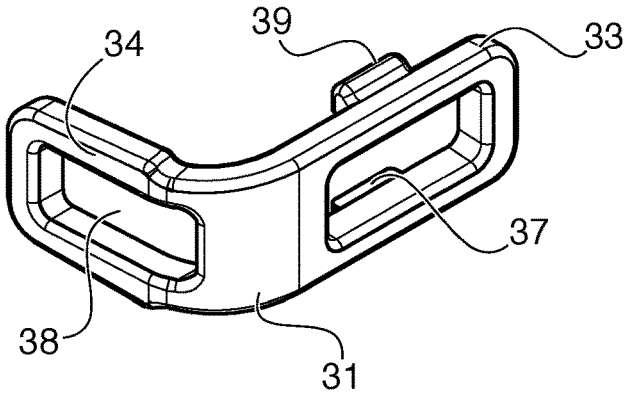
FIG. 5 shows one section of the spring in a perspective view.
Figure 6:
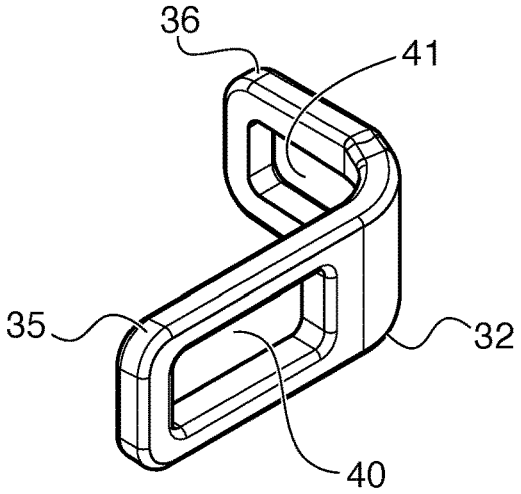
FIG. 6 shows the other section of the spring in a perspective view.
Figure 7:
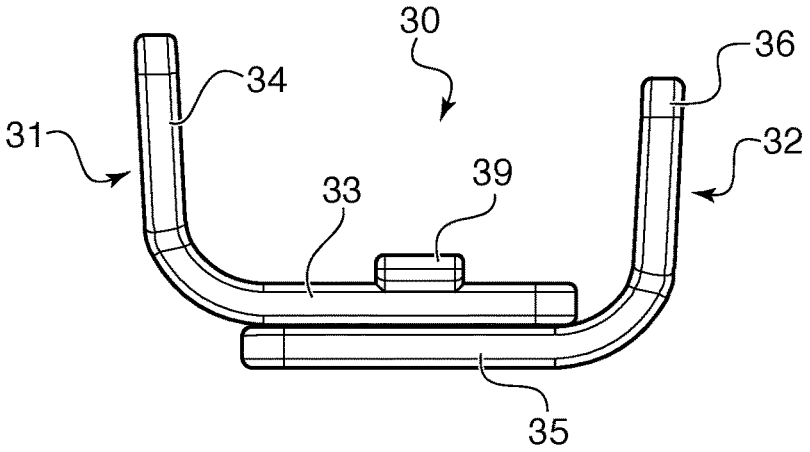
FIG. 7 shows a side view of the spring as assembled.

A spring 30 formed by spring sections 31, 32 as shown in FIGS. 5-7, is attached to locking legs 13, 14. Section 31 is formed by a horizontal leg 33 connected to a vertical leg 34. Section 32 is formed by a horizontal leg 35 connected to a vertical leg 36. Horizontal leg 33 is equipped with a slot 37, and vertical leg 34 is equipped with a slot 38. A hook 39 is formed on each side of slot 37, with the ends of each hook facing inward toward each other. In section 32, horizontal leg 35 is equipped with a slot 40 and vertical leg 36 is equipped with a slot 41. As shown in FIGS. 3 and 4, central leg 16 extends through slots 37, 40 of horizontal legs 33, 35, respectively, and engagement protrusions 18 on each of locking legs 13, 14 extend through slots 38, 41 of vertical legs 34, 36, respectively of spring 30, to connect spring 30 to male portion 10. Hooks 39 on leg 33 engage a ridge 42 on central leg 16 to maintain the position of sections 31, 32 of spring 30 in place on male buckle portion 10.

Sections 31, 32 of spring 30 can be formed of a flexible material such as plastic, while the rest of the components of buckle 1 can be formed of metal. This way, the buckle components can be formed of a very strong, durable, inflexible material metal, as the flexing force is exerted by the plastic spring 30. Slots 38, 41 of legs 34, 36 can be formed so that they are the same width or slightly smaller than engagement protrusions 18 on locking legs 13, 14, so that protrusions 18 are held in place via friction fit.

Because the attachment of locking legs 13, 14 to main body 11 is by a pivot with little resistance, spring 30 is needed to keep locking legs 13, 14, in proper alignment so that locking legs are pre-tensioned to snap into engagement with female portion 20, as will be described in detail below. Spring 30 maintains locking legs 13, 14 in a set position when not under tension and also prevents locking legs 13, 14 from being pivoted outward inadvertently, which can lead to damage of the buckle assembly.

Figure 8:
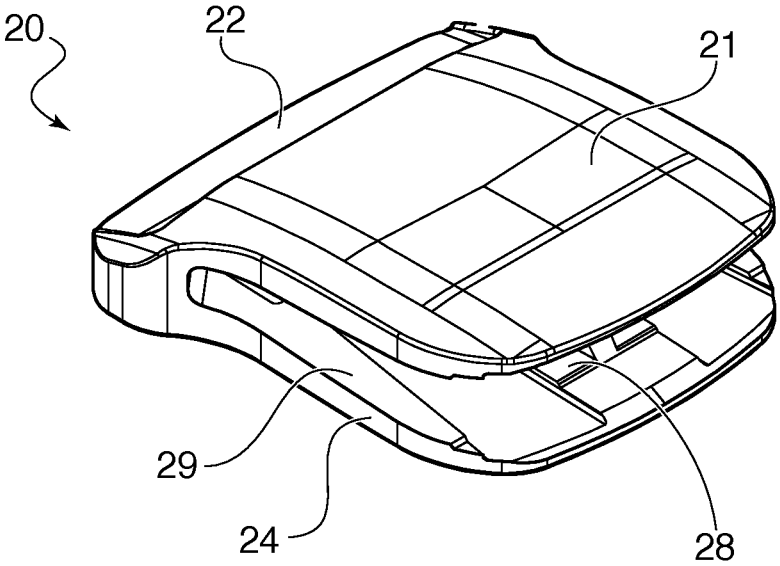
FIG. 8 shows a perspective view of the female portion of the buckle assembly.
Figure 9:
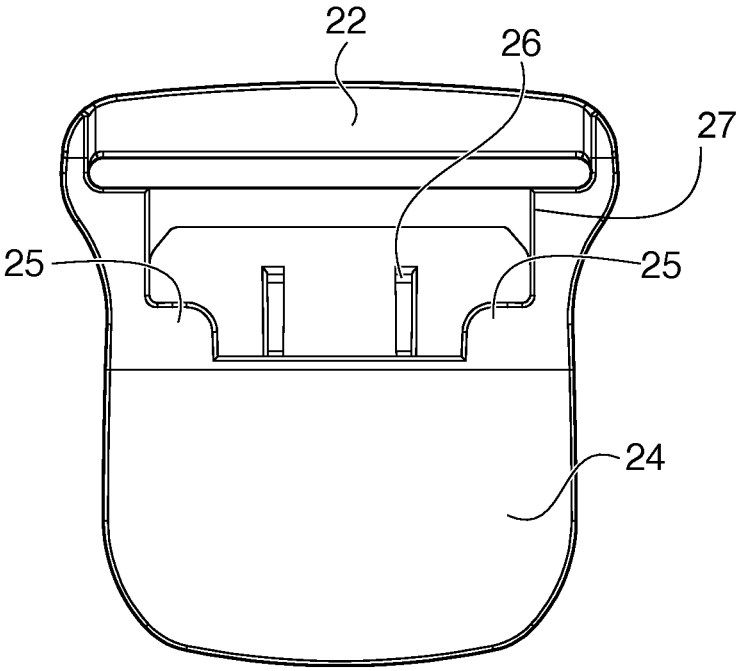
FIG. 9 shows a rear view of the female portion.
Figure 10:
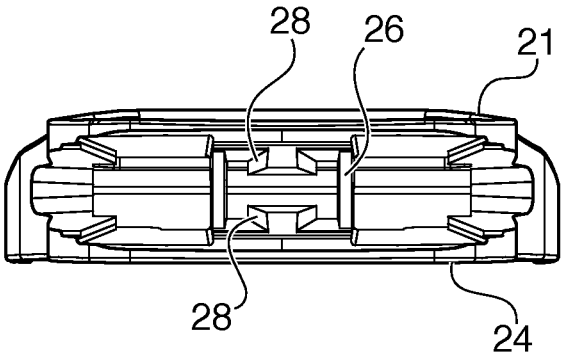
FIG. 10 shows an end view of the female portion.

Female buckle portion 20 is shown in detail in FIGS. 8-10. Female buckle portion 20 has a top wall 21, a bottom wall 24, and a strap retaining bar 22. Elongated guide elements 26 are connected to top face 21 and serve to guide central leg 16 of male buckle portion 10 into female buckle portion 20 in proper alignment. Guide protrusions 28, shown in FIG. 10, are also positioned on both top and bottom walls 21, 24 to keep central leg 16 positioned evenly between the top and bottom walls, and prevent play of the male buckle portion 10 while engaged with the female buckle portion 20. As shown in FIG. 10, guide elements 26 divide female buckle portion 20 into three chambers: a central chamber for central leg 16 and side chambers for locking legs 13, 14.

Figure 11:
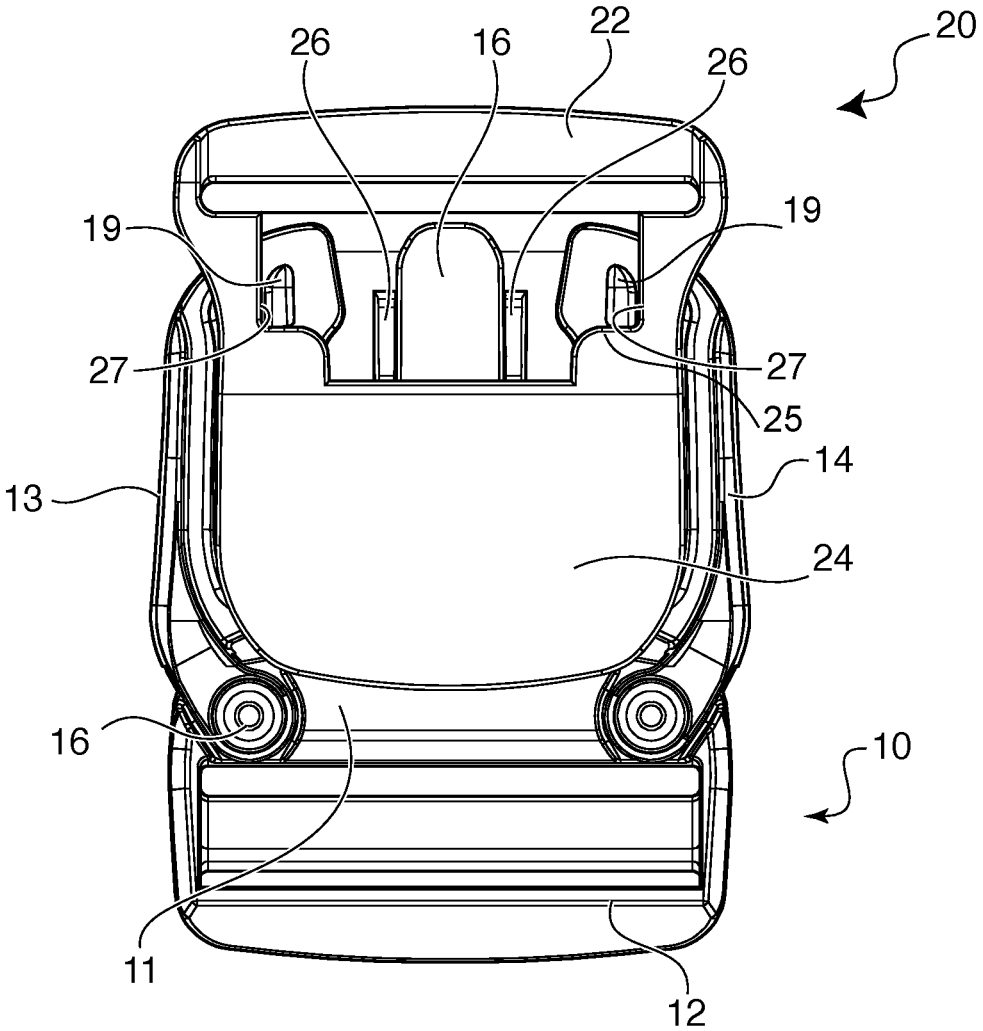
FIG. 11 shows a rear view of the assembled buckle assembly.

The bottom view of the connected buckle assembly 1 is shown in FIG. 11. As shown therein, bottom wall 24 has a cutout so as to form locking edges 25, which run essentially parallel with the insertion direction of the male buckle portion 10 into the female buckle portion 20. When male buckle portion 10 is inserted into female buckle portion 20, central leg 16 is guided by guide elements 26, and locking legs 13, 14 extend through female buckle portion 20 until locking protrusions 19 pass the edge of bottom wall 24. At this point, the locking protrusions 19 are pressed against locking edges 25 of female buckle portion 20 due to the force of spring 30, which forces locking legs 13, 14, into its resting position. Male buckle portion 10 is configured to be engageable with female buckle portion 20 regardless of its orientation, as protrusions 17 on the front face of male buckle portion 10 are also engageable with locking edges 25 in the same manner as protrusions 19 on the rear face of male buckle portion 10. This way, male buckle portion 10 can be locked to female buckle portion 20 without requiring the user to adjust the orientation of the buckle portions with respect to each other. As can be seen in FIG. 8, the height of the cavity 29 into which male buckle portion 10 is inserted decreases along the length of female buckle portion 20, so that the ends of locking legs 13, 14 are pressed into engagement with locking edges 25 by the force of top wall 21 as they pass the end of bottom wall 24. To release male buckle portion 10 from female buckle portion 20, the user presses locking legs 13, 14 toward each other until locking protrusions 19 (or 17) clear locking edges 25, at which point male buckle portion 10 slides out of female buckle portion 20. The sides 27 of the cutout in bottom wall 24 abut locking protrusions 19 to prevent locking legs 13, 14, from rotating beyond the locked position shown in FIG. 10 until male buckle portion 10 is released from female buckle portion 20.

Accordingly, while only a few embodiments of the present invention have been shown and described, it is obvious that many changes and modifications may be made thereunto without departing from the spirit and scope of the invention.

What is claimed is:

1. A buckle comprising:

a main body, a strap retaining bar connected to the main body, two locking legs formed as separate pieces from the main body and pivotably connected to the main body; and a spring disposed between the two locking legs and being attached to both of the locking legs, the spring comprising a first section formed of a vertical leg and a horizontal leg, and a second section formed of a vertical leg and a horizontal leg, wherein the horizontal legs of the first section and second section overlap to form a U-shaped spring, wherein the spring is configured to exert a force against the locking legs when they are pressed inward toward each other.

2. The buckle according to claim 1, wherein the locking legs are each connected to the main body via a pivot pin.

3. The buckle according to claim 1, wherein each of the locking legs has an engagement protrusion formed on an inner surface thereof, and wherein the spring has engagement slots formed in exterior faces of the vertical legs of the first and second sections, and wherein the engagement protrusions extend into the engagement slots to connect the locking legs to the spring.

4. The buckle according to claim 1, wherein the spring is formed from plastic and the main body, strap retaining bar and locking legs are formed from metal.

5. The buckle according to claim 1, further comprising a central leg extending between the locking legs, wherein the central leg extends through a central slot in the horizontal legs of the first and second sections of the spring.

6. The buckle according to claim 5, wherein the central leg is longer than the locking legs.

7. A buckle assembly comprising:

the buckle according to claim 1, which forms a male buckle portion of the buckle assembly, and a female buckle portion, the female buckle portion comprising a top face, a bottom face, and an interior cavity, the bottom face having a cutout forming locking edges, wherein each of the locking legs of the male buckle portion has a front face and a rear face, and a locking protrusion located on at least one of the faces, and wherein the male buckle portion is locked to the female buckle portion by inserting the male buckle portion into the cavity until the locking protrusions engage the locking edges of the female buckle portion, and wherein the male buckle portion is released from the female buckle portion by pressing the locking legs toward each other against the force of the spring until the locking protrusions clear the locking edges.

8. The buckle assembly according to claim 7, wherein the male buckle portion has a central leg extending between the locking legs, the central leg extending through a central slot in the horizontal legs of the first and section sections of the spring, and wherein the female buckle portion has a plurality of guide elements, wherein during insertion of the male portion into the female portion, the central leg is guided between the guide elements.

9. The buckle assembly according to claim 7, wherein the female buckle portion has open sides between the top face and the bottom face, and wherein when the male portion is connected to the female portion, an entire length of each locking leg is exposed outside the female portion.

10. The buckle assembly according to claim 7, wherein each of the locking legs has the locking protrusion on both faces so that the male buckle portion is lockable to the female buckle portion in two different orientations of the male buckle portion.

* * * * *